US010743678B2

(12) United States Patent
Salazar et al.

(10) Patent No.: US 10,743,678 B2
(45) Date of Patent: Aug. 18, 2020

(54) WRAP CARRIER

(71) Applicant: Blue Box Toy Factory Limited, Kowloon (HK)

(72) Inventors: Maureen O'Connor Salazar, Chicago, IL (US); Stacy Castro, Verona, WI (US); Leslie Roeder, New York, NY (US)

(73) Assignee: BLUE BOX TOY FACTORY LIMITED, Kowloon (HK)

( * ) Notice: Subject to any disclaimer, the term of this patent is extended or adjusted under 35 U.S.C. 154(b) by 0 days.

(21) Appl. No.: 16/124,516

(22) Filed: Sep. 7, 2018

(65) Prior Publication Data

US 2019/0075936 A1 Mar. 14, 2019

Related U.S. Application Data

(60) Provisional application No. 62/556,881, filed on Sep. 11, 2017.

(51) Int. Cl.

| | |
|---|---|
| ***A47D 13/02*** | (2006.01) |
| ***A45F 3/04*** | (2006.01) |
| *A45F 3/00* | (2006.01) |

(52) U.S. Cl.

CPC ..... *A47D 13/02* (2013.01); *A45F 3/047* (2013.01); *A47D 13/025* (2013.01); *A45F 2003/003* (2013.01); *A45F 2003/045* (2013.01)

(58) Field of Classification Search

CPC ..... A47D 13/02; A47D 13/025
USPC ..... 224/158–161
See application file for complete search history.

(56) References Cited

U.S. PATENT DOCUMENTS

| | | | | |
|---|---|---|---|---|
| 672,546 | A | 4/1901 | Bliss | |
| 691,791 | A | 1/1902 | Meeker | |
| 738,614 | A | 9/1903 | Isler | |
| 4,009,808 | A | 3/1977 | Sharp | |
| 5,632,425 | A * | 5/1997 | Hull | A47D 13/025 2/111 |
| D614,861 | S | 5/2010 | Smyth et al. | |
| 8,393,505 | B2 | 3/2013 | Coote | |
| 8,550,316 | B2 | 10/2013 | Coote | |
| 8,925,772 | B2 | 1/2015 | Vukovics | |
| 8,973,793 | B2 | 3/2015 | Arvan | |
| 9,138,071 | B2 | 9/2015 | Larch | |
| 9,179,758 | B2 | 11/2015 | Calilung et al. | |
| 9,198,525 | B2 | 12/2015 | Wernick et al. | |
| 9,241,582 | B2 | 1/2016 | Gilboa et al. | |
| 9,380,886 | B2 | 7/2016 | Rahni | |

(Continued)

FOREIGN PATENT DOCUMENTS

WO WO-2019009744 A2 * 1/2019 ..... A47D 13/025

*Primary Examiner* — Scott T McNurlen
(74) *Attorney, Agent, or Firm* — Stetina Brunda Garred and Brucker; Mark B. Garred

(57) ABSTRACT

A wrap type infant carrier which also integrates certain attributes of mei tai and SSC carriers to provide an optimal meld of some of the most desirable attributes of these existing carriers, the present carrier thus providing the comfort and closeness of a wrap carrier, but further being configured to be easily fitted to the wearer, thus avoiding any excessive learning curve associated with its use. In addition to being easy to use, the present carrier is also configured to more effectively distribute the load to the caregiver to mitigate muscle strain or fatigue.

17 Claims, 2 Drawing Sheets

(56) References Cited

U.S. PATENT DOCUMENTS

| | | | | |
|---|---|---|---|---|
| 9,402,430 | B2 | 8/2016 | Jensen et al. | |
| 9,545,159 | B2 | 1/2017 | Wang | |
| 2007/0278264 | A1 | 12/2007 | Chesal et al. | |
| 2009/0078729 | A1 | 3/2009 | Coote | |
| 2011/0163136 | A1 | 7/2011 | Billingham | |
| 2011/0290831 | A1 | 12/2011 | Wang | |
| 2012/0152987 | A1 | 6/2012 | Beltrame et al. | |
| 2012/0199619 | A1* | 8/2012 | Zack | A47D 13/025 224/160 |
| 2012/0286002 | A1 | 11/2012 | Dardel et al. | |
| 2012/0318833 | A1* | 12/2012 | Zack | A47D 13/025 224/160 |
| 2014/0084031 | A1 | 3/2014 | Bowden | |
| 2014/0231473 | A1 | 8/2014 | Bailey et al. | |
| 2014/0263491 | A1* | 9/2014 | Telford | A47D 13/025 224/160 |
| 2014/0319189 | A1 | 10/2014 | Hoppener-Visser | |
| 2017/0150826 | A1 | 6/2017 | Salazar et al. | |
| 2018/0206653 | A1* | 7/2018 | Andrus | A47D 13/025 |

* cited by examiner

WRAP CARRIER

CROSS-REFERENCE TO RELATED APPLICATIONS

The present application claims priority to U.S. Provisional Patent Application Ser. No. 62/556,881 entitled Wrap Carrier filed Sep. 11, 2017, the disclosure of which is incorporated herein by reference.

STATEMENT RE: FEDERALLY SPONSORED RESEARCH/DEVELOPMENT

Not Applicable

BACKGROUND

1. Technical Field

The present disclosure generally relates to wrap-type infant carriers adapted to be worn by an adult to support and carry an infant or other young child. More particularly, the present disclosure is directed to a wrap carrier with improved features that allow the carrier to more easily be fitted to the caregiver and the infant, and to more effectively distribute weight/load to mitigate muscle fatigue and strain to the caregiver.

2. Description of the Related Art

Wrap-type infant carriers or "wraps" are well known to parents and other persons involved in child care. Wraps are generally considered to be the most traditional and simple of all carriers, and typically come in a variety of sizes and fabrics. In many instances, they can be used to carry an infant, toddler, or child in a variety of positions including front, hip, and back carries. Much of the appeal of wrap carriers lies in their degree of adjustability to meet the specific needs of the individual wearer or caregiver. Along these lines, their lack of hardware or minimal use of hardware is considered to make them ideal for snuggling newborns, though they are also used for babies and toddlers of any age.

Another type of infant carrier well known to parents and caregivers is referred as a "mei tai" carrier, which is a modernized traditional Asian-style baby carrier. These carriers typically comprise a panel of fabric with two shorter straps that go around the waist and two longer straps to wrap over the shoulder. Modern mei tai straps are often padded or made very wide to provide extra comfort for the wearer. Because they lack buckles and are tied to create a custom fit each time, mei tai carriers are often easily shared between multiple caregivers, and may also be used for front, back, and hip carries. Though they are ideal for older babies and toddlers, mei tai carriers can also be safely used with newborns Yet another type of infant carrier well known to parents and caregivers is referred as a soft structured carrier or "SSC." SSC's offer a mix of comfort, convenience and accessibility that is appealing to many caregivers, with many featuring a thickly padded waistband and shoulder straps for a comfortable, ergonomic fit, capable of use for front, back, and sometimes hip carries. The straps typically are adjustable for a custom fit, and often these carriers have additional features such as sleep hoods, front pockets, adjustable seats, etc. While some SSC's may require the use of a special infant insert below a certain weight and size, most quality, SSC carriers can be used well into toddlerhood.

However, one of the primary drawbacks associated with wrap and mei tai carriers is related to the learning curve associated with their proper use. In this regard, it typically takes some measure of practice to master the use of these types of carriers in any one of the configurations in which it is suitable for supporting an infant or child. Indeed, many wraps and mei tais are somewhat complicated in their design and/or operation, making use thereof difficult to learn and perform, especially upon the initial usage thereof. Even for those experienced users, the design often makes donning of the wrap or mei tai carrier very arduous, particularly when a significant amount of attention and effort is simultaneously required to support the infant. While SSC's have a comparatively lower learning curve because they go on and off more like a backpack, they often lack many of the aforementioned benefits of wraps and mei tais.

Another drawback of certain wraps and mei tais is that their structural features and arrangement often lends itself to the transfer of load or weight (particularly when used for toddlers or older children) to the wearer in a manner which accelerates muscle fatigue, which may lead to muscle strain, or more serious injury. Muscle fatigue and strain is particularly common in the lower back or lumbar region of the caregiver.

The infant carrier described below addresses these drawbacks by providing what is predominantly a wrap type carrier, but one which also integrates certain attributes of mei tai and SSC carriers to provide an optimal meld of some of the most desirable attributes of these existing carriers. Thus, the present carrier, while providing the comfort and closeness of a wrap carrier, is also configured to be easily fitted to the wearer, thus avoiding any excessive learning curve associated with its use. In addition to being easy to use, the present carrier is also configured to more effectively distribute the load to the caregiver to mitigate muscle strain or fatigue. These and other aspects of the present infant carrier will be discussed in more detail below.

BRIEF SUMMARY

Various aspects of the present disclosure are directed toward a wrap type infant carrier which also integrates certain attributes of mei tai and SSC carriers to provide an optimal meld of some of the most desirable attributes of these existing carriers, the present carrier thus providing the comfort and closeness of a wrap carrier, but further being configured to be easily fitted to the wearer, thus avoiding any excessive learning curve associated with its use. In addition to being easy to use, the present carrier is also configured to more effectively distribute the load to the caregiver to mitigate muscle strain or fatigue.

According to one embodiment of the present disclosure, the infant carrier comprises two wrap panels which are permanently, fixedly attached to a back harness. The bottom ends of the wrap panels are permanently attached to a belt pocket. A belt is advanced through the belt pocket, but secured thereto via stitching, with the opposed ends of the belt being secured to the back harness via adjuster hardware and respective ones of a pair of adjuster loops. The carrier further includes a sash which is extensible about the waist of a wearer, and is permanently attached to the belt pocket.

The presently contemplated embodiment will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
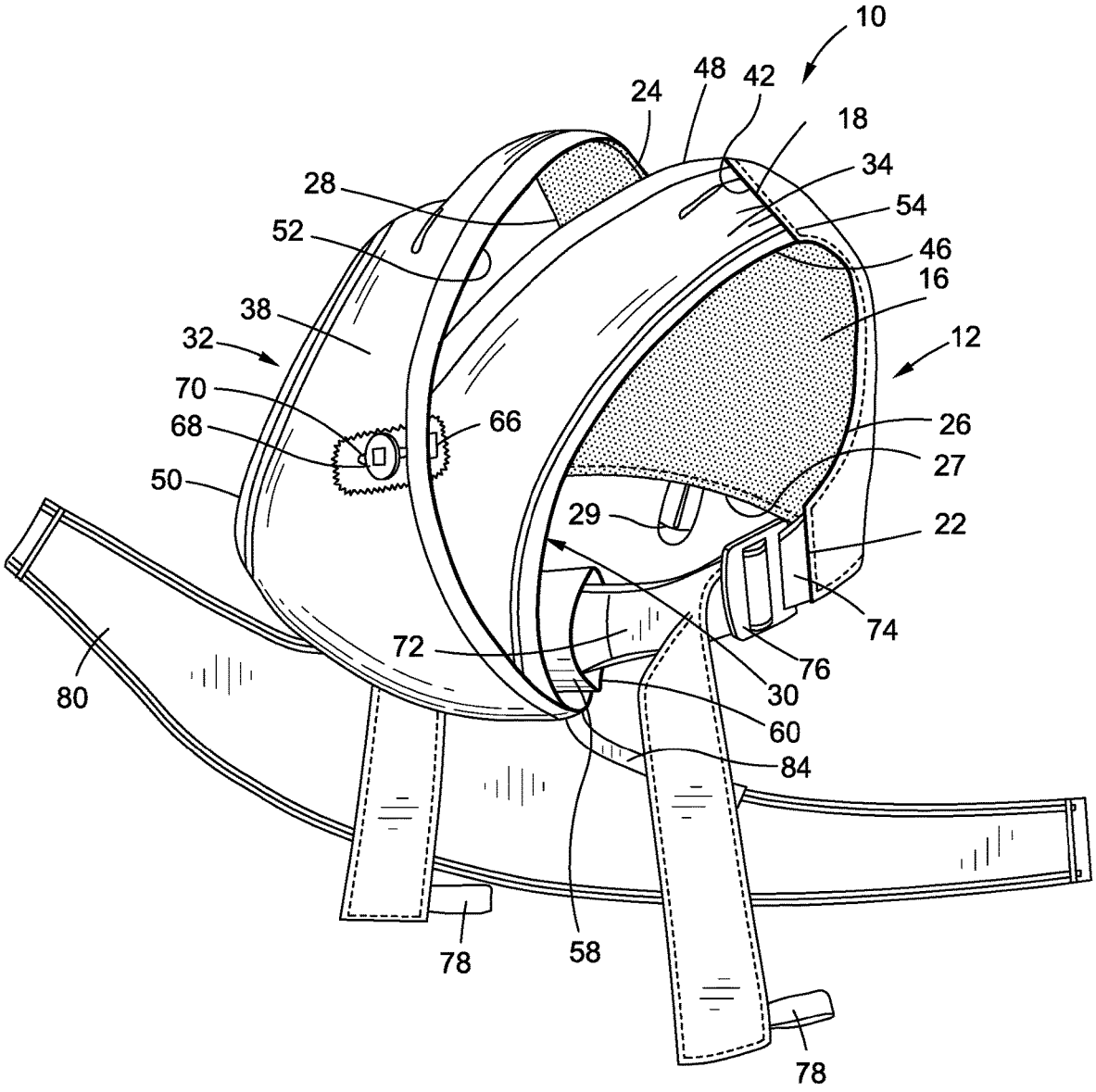
FIG. 1 is a front perspective view of an infant carrier constructed in accordance with the present disclosure.

Referring now to the drawings, wherein the showings are for purposes of illustrating one embodiment of the present disclosure only, and not for purposes of limiting the same, there is depicted a wrap type infant carrier 10 constructed in accordance with the present disclosure. The infant carrier 10 integrates certain attributes of mei tai and SSC carriers to provide an optimal meld of some of the most desirable attributes of these existing carriers, the carrier 10 thus providing the comfort and closeness of a wrap carrier, but further being configured to be easily fitted to the wearer, thus avoiding any excessive learning curve associated with its use. In addition to being easy to use, the carrier 10 is also configured to more effectively distribute the load to the caregiver to mitigate muscle strain or fatigue. The carrier 10 is additionally configured to be worn in a front carry configuration.

Figure 2:
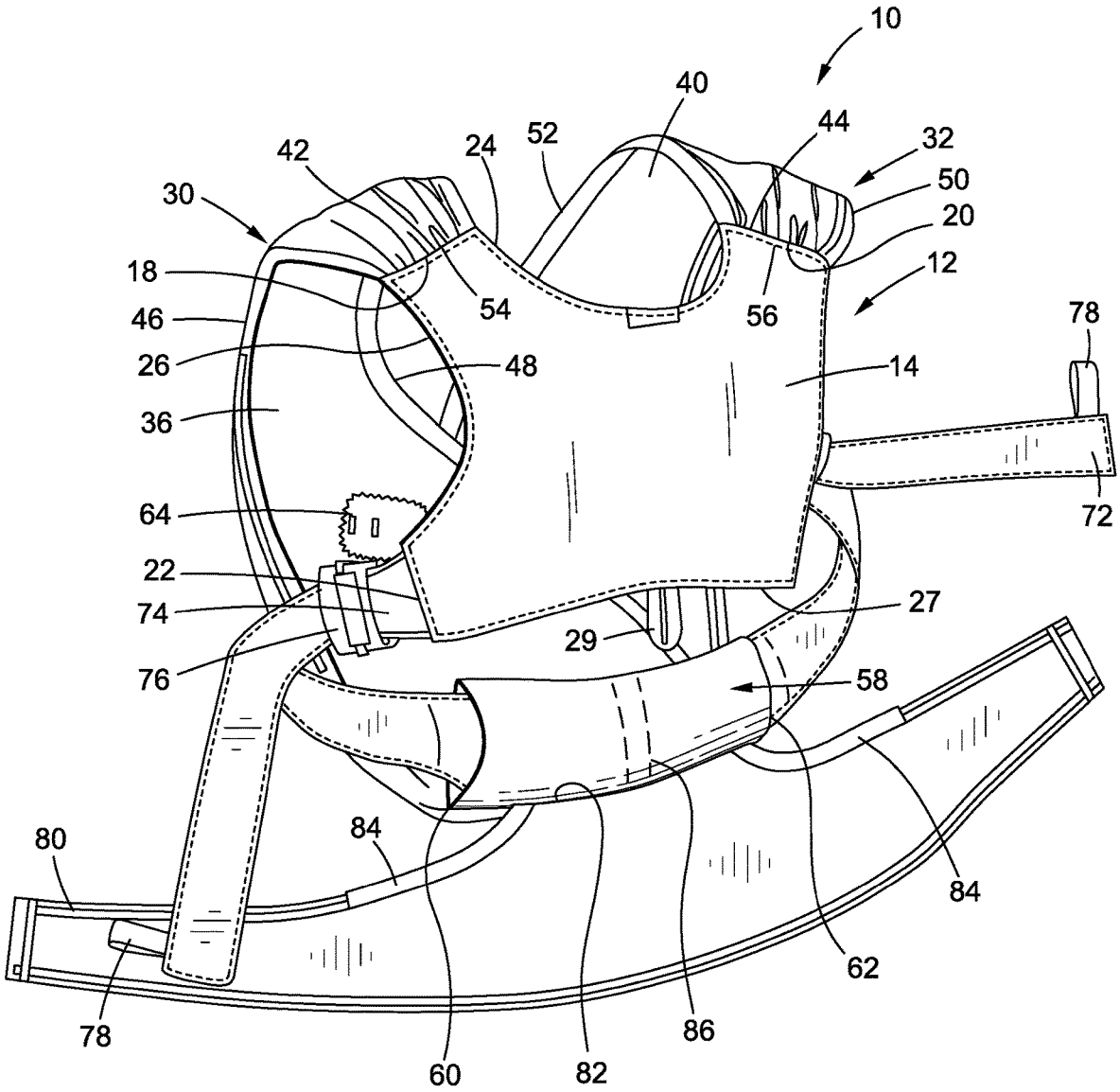
FIG. 2 is a rear perspective view of an infant carrier constructed in accordance with the present disclosure.

Referring now to the FIGS. 1-2, the carrier 10 comprises a back panel or harness 12 defining an exteriorly presented outer surface 14, and an opposed, interiorly presented inner surface 16. When viewed from the perspective shown in FIG. 2, the back harness 12 further defines a first (left) shoulder edge segment 18, a second (right) shoulder edge segment 20, a first (left) torso edge segment 22, and a second (right) torso edge segment (unlabeled). The first and second shoulder edge segments 18, 20 are preferably of equal length, as are the first torso edge segment 22 and second torso edge segment. Extending between the inner ends of the first and second shoulder edge segments 18, 20 is an arcuate (i.e., concave) top edge segment 24 of the back harness 12. Also, extending between the outer end of the first shoulder edge segment 18 and the upper end of the first torso edge segment 22 is an arcuate (i.e., concave) first (left) side edge segment 26 back harness 12. Similarly, extending between the outer end of the second shoulder edge segment 20 and the upper end of the second torso edge segment is an arcuate (i.e., concave) second (right) side edge segment 28 back harness 12. The back harness 12 further defines a bottom edge segment 27 which extends between the lower end of the first torso edge segment 22 and the lower end of the second torso edge segment.

Protruding downwardly from the approximate center of the bottom edge segment 27 of the back harness 12 is a harness loop 29. The harness loop 29 is sized to be easily graspable by the wearer's fingers, and is used for adjusting the height of the back harness 12 on the wearer's back subsequent to the carrier 10 being fitted onto the body of the wearer.

The carrier 10 further comprises a first (left) wrap panel 30 and a second (right) wrap panel 32. The first wrap panel 30 defines an exteriorly presented outer surface 34, and an opposed, interiorly presented inner surface 36. Similarly, the second wrap panel 32 defines an exteriorly presented outer surface 38, and an opposed, interiorly presented inner surface 40. The first wrap panel 32 further defines a top edge segment 42, with the second wrap panel 32 defining a top edge segment 44. Though not labeled in FIGS. 1 and 2, the first wrap panel 30 and the second wrap panel 32 each further define a bottom edge segment. The top edge segments 42, 44 are preferably of equal length, as are the bottom edge segments of the first and second wrap panels 30, 32. In the first wrap panel 30, an outer side edge segment 46 thereof extends between the outer end of the top edge segment 42 and a corresponding one of the opposed ends of its bottom edge segment, with an inner side edge segment 48 thereof extending between the inner end of the top edge segment 42 and the remaining one of the opposed ends of its bottom edge segment. Also, in the second wrap panel 32, an outer side edge segment 50 thereof extends between the outer end of the top edge segment 44 and a corresponding one of the opposed ends of its bottom edge segment, with an inner side edge segment 52 thereof extending between the inner end of the top edge segment 44 and the remaining one of the opposed ends of its bottom edge segment.

In the carrier 10 the first and second shoulder edge segments 18, 20 defined by the back harness 12, and the top edge segments 42, 44 defined by respective ones of the first and second wrap panels 30, 32, are of generally equal length. In this regard, in constructing the carrier 10, a stitched seam 54 is preferably used to secure the first wrap panel 30 to the back harness 12 proximate the first shoulder edge segment 18 and top edge segment 42. Similarly, a stitched seam 56 is preferably used to secure the second wrap panel 32 to the back harness 12 proximate the second shoulder edge segment 20 and top edge segment 44. When the first and second wrap panels 30, 32 and back harness 12 are secured to each other in this manner, the outer surface 14 of the back harness 14 is generally continuous with the outer surfaces 34, 38 of the first and second wrap panels 30, 32, with the inner surface 16 of the back harness 14 being generally continuous with the inner surfaces 36, 40 of the first and second wrap panels 30, 32.

The carrier 10 further includes an elongate, tubular sleeve or belt pocket 58 which, as viewed from the perspective shown in FIG. 2, has a first (left) pocket end 60 and an opposed second (right) pocket end 62. In the carrier 10, the first and second wrap panels 30, 32 are each secured to the belt pocket 58, preferably through the use of one or more stitched seams which is/are proximate the bottom edge segments of the first and second wrap panels 30, 32. Along these lines, the bottom edge segments of the first and second wrap panels 30, 32 and the belt pocket 58 are preferably sized to be of generally equal length such that when the first and second wrap panels 30, 32 are secured to the belt pocket 58, the opposed ends of each of the bottom edge segments of the first and second wrap panels 30, 32 are substantially flush with respective ones of the opposed first and second pocket ends 60, 62 of the belt pocket 58.

As is apparent from FIGS. 1 and 2, each of the first and second wrap panels 30, 32 is of gradually increasing width as it extends from its corresponding top edge segment 42, 44 to its bottom edge segment, i.e., the length of the bottom edge segments exceed that of the top edge segments 42, 44. The first and second wrap panels 30, 32 are also secured to both the back harness 12 and the belt pocket 58 so as to be disposed in partially overlapping relation to each other. In greater detail, as is apparent from FIGS. 1 and 2, approximately the lower third of the first wrap panel 30 is overlapped by the second wrap panel 32. Within this overlapped region, the outer surface 34 of the first wrap panel 30 faces the inner surface 40 of the second wrap panel 32. However, those of ordinary skill in the art will recognize that the first and second wrap panels 30, 32 may optionally be manipulated such that more or perhaps even less than approximately one-third of the lengths thereof are disposed in overlapping relation to each other.

In the carrier 10, a portion of the inner surface 36 of the first wrap panel 30 approximately midway between the top edge segment 42 and its bottom edge segment is provided with a button reinforcement patch 64 which is secured thereto. Attached to this button reinforcement patch 64 is a button loop 66 which protrudes from the opposed outer surface 34 of the first wrap panel 30. Attached to the distal end of the button loop 66 is a button 68. The button 68 is adapted to be selectively advanceable through a corresponding button hole 70 formed in a complementary location of the second wrap panel 32 and extending between the outer and inner surfaces 38, 40 thereof. As will be recognized, the advancement of the button 68 through the button hole 70 assists in maintaining a fixed relationship between the first and second wrap panels 30, 32, i.e., the overlapped portions of the first and second wrap panels 30, 32 are impeded from being separated from each other. Those of ordinary skill in the art will recognize that alternative fasteners of fastening mechanisms such as snaps, toggles or layers of hook and loop fastener material may be substituted for the button 68 and button hole 70 without departing from the spirit and scope of the present disclosure. Also, it is contemplated that more than one fastener or fastening mechanism may be used to secure the first and second wrap panels 30, 32 to each other.

The carrier 10 further comprises an elongate torso belt 72 which it is advanced through the belt pocket 58 and is partially extensible about the torso of a wearer. The torso belt 72 is also adjustably secured to the back harness 12. In greater detail, the carrier 10 includes an identically configured pair of adjuster loops 74 which are preferably secured through the use of stitched seams to the back harness 12 proximate respective ones of the first torso edge segment 22 and the second torso edge segment thereof. The carrier 10 also includes and identically configured pair of adjuster buckles 76 which are permanently attached to respective ones of the adjuster loops 74. In the carrier 10, opposed end portions of the torso belt 72 are advanced through respective ones of the adjuster buckles 76, which effectively secures the torso belt 72 to the back harness 12. As will be recognized, the effective length of the torso belt 72 extending between the adjuster buckles 76 can be selectively increased or decreased as result of the use of the adjuster buckles 76 the interface modality between the torso belt 72 and the back harness 12. It is also contemplated that in the carrier 10, the torso belt 72 may be outfitted with a pair of storage loops 78 which protrude therefrom proximate respective ones of the opposed ends thereof. The storage loops 78 are adapted to accommodate portions of the torso belt 72 for the compact, efficient storage thereof.

The carrier 10 further comprises an elongate waist sash 80 which is permanently attached to the belt pocket 58, and is selectively extensible and securable about the wearer's waist. In greater detail, when viewed from the perspective shown in FIG. 2, the sash 80 defines a top edge segment 82, and is preferably attached to the belt pocket 58 through the use of a stitched seam which is proximate to the top edge segment 82. The sash 80 also has a tapered profile, gradually narrowing as it extends from its central portion defining the top edge segment 82 to each of its opposed ends. It is contemplated that the opposed end portions of the sash 80 defining the opposed ends thereof may be releasably secured to each other through the use of any one of a multiplicity of different fastener arrangements, including but not limited to complementary male and female buckle parts, and hook and loop fastener material. The opposed end portions of the sash 80 can also simply be directly tied to each other. Portions of the upper edge of the sash 80 extending to the top edge segment 82 thereof are also each preferably reinforced with a rib binding 84.

In using the carrier 10, it is contemplated that the wearer's head will be advanced through the opening between the first and second wrap panels 30, 32 proximate the top edge segments 42 44 thereof such that the back harness covers a portion of the wearer's back and the first and second wrap panels 30, 32 crisscross over a portion of the wearer's chest. After the back harness 12 has been properly positioned on the wearer's back through the use of the harness loop 29, the length of the torso belt 72 extending partially about the wearer's torso may be adjusted through the use of the adjuster buckles 76 to achieve the appropriate fit. The sash 80 may then be extended about and secured to the wearer's waist as well.

As seen in FIGS. 1 and 2, in fitting the carrier 10 to the wearer, the belt pocket 58 is turned or folded upwardly such that it overlaps a portion of the inner surface 36 of the first wrap panel 30. This orientation results in portions of the first and second wrap panels 30, 32 proximate the bottom edge segments thereof effectively defining a seat or bucket portion of the carrier 10 which, when the carrier 10 is properly worn, effectively transfers the weight of the infant or toddler therein not only into the torso belt 72 (and hence the back harness 12), but further into the sash 80, for distribution into the wearer's hips, back and lower back. The weight of the infant or toddler is also effectively distributed to the wearer's shoulders and back via the first and second wrap panels 30, 32 which extend at least partially over the wearer's shoulders to the back harness 12. Along these lines, the infant or toddler is placed in the carrier 10 so that that he or she is snuggly captured between the first and second wrap panels 30, 32 and the wearer's body, with the buttocks region of the infant or toddler being accommodated by the seat or bucket portion collectively defined by the first and second wrap panels 30, 32. As indicated above, if needed for a higher level of security based on the size of the infant or toddler being carried in the carrier 10, the button 68 may optionally be advanced through the button hole 70 to assist in impeding movement (e.g., separation) of the first and second wrap panels 30, 32 from each other.

As seen in FIG. 2, in the carrier 10, it is contemplated that a central portion of the belt pocket 58 may be rigidly attached to the torso belt 72, preferably through the use of stitching 86. Such attachment assists in preventing the rotation of the belt pocket 58 relative to the torso belt 72, and further results in the belt pocket 58 defining opposed, separate first and second pocket sections on either side of the stitching 86, each such pocket section being slidably, adjustably positionable along a corresponding portion of the torso belt 72. In greater detail, each of these pocket sections of the belt pocket 58 is movable between a fully expanded state (shown in FIGS. 1 and 2) maximizing the width of the aforementioned seat or bucket portion, and a fully collapsed state minimizing the width of such seat or bucket portion. The pocket sections may also be deployed into any one of a multiplicity of partially expanded states between the fully expanded and collapsed states. In this regard, as will be recognized, the adaptability of the carrier 10 to the infant's physical features is enhanced by the width adjustability of the seat or bucket portion thereof.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure. By way of example, it is contemplated that the belt pocket 58 could be eliminated, with both the wrap panels 30, 32 and the sash 80 being attached directly to the torso belt 72, thus removing the above-described cinching/width adjustability feature attributable to the movement of the opposed pocket sections of the belt pocket 58 relative to the torso belt 72.

What is claimed is:

1. An infant carrier wearable by a wearer for carrying an infant, the infant carrier comprising:

a back harness comprising first and second shoulder edge segments which are of substantially equal length to each other;

first and second wrap panels attached to the back harness and at least partially overlapping each other, at least portions of the first and second wrap panels being extensible over the wearer's shoulders and collectively defining an infant carrying area of the carrier which includes a seat portion, each of the first and second wrap panels comprising:

a top edge segment; and a bottom edge segment;

the top edge segments of the first and second wrap panels being of substantially equal length to each other and to each of the first and second shoulder edge segments and attached to respective ones of the first and second shoulder edge segments, with each of the first and second wrap panels being of gradually increasing width as it extends from the top edge segment to the bottom edge segment thereof;

an elongate belt pocket attached to the bottom edge segment of each of the first and second wrap panels;

a torso belt extensible at least partially about the wearer's torso, and including portions advanced through the belt pocket and cooperatively engaged to the back harness; and a sash attached to the belt pocket and extensible about the wearer's waist;

wherein a portion of the belt pocket is rigidly attached to the torso belt such that the belt pocket defines separate first and second pocket sections which are each slidably, adjustably positionable along a corresponding portion of the torso belt advanced therethrough between a fully expanded state maximizing the width of the seat portion, a fully collapsed state minimizing the width of the seat portion, and any one of a multiplicity of partially expanded states between the fully expanded and collapsed states.

2. The infant carrier of claim 1, wherein the first and second wrap panels are outfitted with at least one fastening mechanism operative to releasably secure the first and second wrap panels to each other in a manner impeding relative movement therebetween.

3. The infant carrier of claim 1 wherein the first and second wrap panels are sized and shaped such that when attached to and extended between the back harness and the belt pocket, at least a lower one-third of the length of the first wrap panel is overlapped by the second wrap panel.

4. The infant carrier of claim 1 wherein the first and second wrap panels and the sash are attached to the belt pocket so as to extend along a common seam or respective ones of a pair of seams disposed in close proximity to each other such that if the belt pocket is folded to assume an overlapping relation to at least the first wrap panel, the sash is suspended from the belt pocket such that a majority of a width of the sash protrudes below the seat portion.

5. The infant carrier of claim 1, wherein:

each of the first and second wrap panels defines opposed inner and outer surfaces;

the back harness defines opposed inner and outer surfaces;

the inner surfaces of the first and second wrap panels are substantially continuous with the inner surface of the back harness; and the outer surfaces of the first and second wrap panels are substantially continuous with the outer surface of the back harness.

6. The infant carrier of claim 1, wherein:

the bottom edge segments of the first and second wrap panels and the belt pocket each define opposed ends;

the bottom edge segments of the first and second wrap panels and the belt pocket are sized to be of substantially equal length; and the bottom edge segments are attached to the belt pocket such that the opposed end of each bottom edge segments are substantially flush with respective ones of the opposed ends of the belt pocket.

7. The infant carrier of claim 6 wherein the first and second wrap panels are sized and shaped such that when attached to and extended between the back harness and the belt pocket, at least a lower one-third of the length of the first wrap panel is overlapped by the second wrap panel.

8. The infant carrier of claim 6 wherein the bottom edge segments of the first and second wrap panels and the sash are attached to the belt pocket so as to extend along a common seam or respective ones of a pair of seams disposed in close proximity to each other such that if the belt pocket is folded to assume an overlapping relation to at least the first wrap panel, the sash is suspended from the belt pocket such that a majority of a width of the sash protrudes below the seat portion.

9. An infant carrier wearable by a wearer for carrying an infant, the infant carrier comprising:

a back harness comprising first and second shoulder edge segments which are of substantially equal length to each other;

first and second wrap panels attached to the back harness and at least partially overlapping each other, at least portions of the first and second wrap panels being extensible over the wearer's shoulders and collectively defining an infant carrying area of the carrier which includes a seat portion, each of the first and second wrap panels comprising:

a top edge segment; and a bottom edge segment;

the top edge segments of the first and second wrap panels being of substantially equal length to each other and to each of the first and second shoulder edge segments and attached to respective ones of the first and second shoulder edge segments, with each of the first and second wrap panels being of gradually increasing width as it extends from the top edge segment to the bottom edge segment thereof;

a torso belt extensible at least partially about the wearer's torso, and including portions cooperatively engaged to the bottom edge segment of each of the first and second wrap panels, and to the back harness; and a sash cooperatively engaged to the bottom edge segment of each of the first and second wrap panels, and extensible about the wearer's waist.

10. The infant carrier of claim 9, wherein the first and second wrap panels are outfitted with at least one fastening mechanism operative to releasably secure the first and second wrap panels to each other in a manner impeding relative movement therebetween.

11. The infant carrier of claim 9 wherein the first and second wrap panels are sized and shaped such that when attached to and extended between the back harness and the torso belt, at least a lower one-third of the length of the first wrap panel is overlapped by the second wrap panel.

12. The infant carrier of claim 9 wherein the first and second wrap panels are cooperatively engaged to the torso belt and the sash such that if the torso belt assumes an overlapping relation to at least the first wrap panel, the sash is suspended from the first and second wrap panels such that a majority of a width of the sash protrudes below the seat portion.

13. The infant carrier of claim 9, wherein:

each of the first and second wrap panels defines opposed inner and outer surfaces;

the back harness defines opposed inner and outer surfaces;

the inner surfaces of the first and second wrap panels are substantially continuous with the inner surface of the back harness; and the outer surfaces of the first and second wrap panels are substantially continuous with the outer surface of the back harness.

14. An infant carrier wearable by a wearer for carrying an infant, the infant carrier comprising:

a back harness comprising first and second shoulder edge segments which are of substantially equal length to each other;

first and second wrap panels which at least partially overlap each other and each comprise:

a top edge segment; and a bottom edge segment;

the top edge segments of the first and second wrap panels being of substantially equal length to each other and to each of the first and second shoulder edge segments, with each of the first and second wrap panels being of gradually increasing width as it extends from the top edge segment to the bottom edge segment thereof;

the top edge segments of the first and second wrap panels being attached to respective ones of the first and second shoulder edge segments of the harness, at least portions of the first and second wrap panels being extensible over the wearer's shoulders and collectively defining an infant carrying area of the carrier which includes a seat portion;

an elongate belt pocket attached to the bottom edge segments of the first and second wrap panels;

a torso belt extensible at least partially about the wearer's torso, and including portions advanced through the belt pocket and cooperatively engaged to the back harness; and a sash attached to the belt pocket and extensible about the wearer's waist;

wherein a portion of the belt pocket is rigidly attached to the torso belt such that the belt pocket defines separate first and second pocket sections which are each slidably, adjustably positionable along a corresponding portion of the torso belt advanced therethrough between a fully expanded state maximizing the width of the seat portion, a fully collapsed state minimizing the width of the seat portion, and any one of a multiplicity of partially expanded states between the fully expanded and collapsed states.

15. The infant carrier of claim 14, wherein:

each of the first and second wrap panels defines opposed inner and outer surfaces;

the back harness defines opposed inner and outer surfaces;

the inner surfaces of the first and second wrap panels are substantially continuous with the inner surface of the back harness; and the outer surfaces of the first and second wrap panels are substantially continuous with the outer surface of the back harness.

16. An infant carrier wearable by a wearer for carrying an infant, the infant carrier comprising:

a back harness comprising first and second shoulder edge segments which are of substantially equal length to each other;

first and second wrap panels which at least partially overlap each other and each comprise:

a top edge segment; and a bottom edge segment;

the top edge segments of the first and second wrap panels being of substantially equal length to each other and to each of the first and second shoulder edge segments, with each of the first and second wrap panels being of gradually increasing width as it extends from the top edge segment to the bottom edge segment thereof;

the top edge segments of the first and second wrap panels being attached to respective ones of the first and second shoulder edge segments of the harness, at least portions of the first and second wrap panels being extensible over the wearer's shoulders and collectively defining an infant carrying area of the carrier which includes a seat portion;

a torso belt extensible at least partially about the wearer's torso, and including portions cooperatively engaged to the bottom edge segments of the first and second wrap panels, and to the back harness; and a sash cooperatively engaged to the bottom edge segments of the first and second wrap panels, and extensible about the wearer's waist.

17. The infant carrier of claim 16, wherein:

each of the first and second wrap panels defines opposed inner and outer surfaces;

the back harness defines opposed inner and outer surfaces;

the inner surfaces of the first and second wrap panels are substantially continuous with the inner surface of the back harness; and the outer surfaces of the first and second wrap panels are substantially continuous with the outer surface of the back harness.

* * * * *